US010562300B2

(12) United States Patent
Canto Estany et al.

(10) Patent No.: US 10,562,300 B2
(45) Date of Patent: Feb. 18, 2020

(54) ADAPTIVE PRINT HEAD CALIBRATION PROCESS

(71) Applicant: HEWLETT-PACKARD DEVELOPMENT COMPANY, L.P., Fort Collins, CO (US)

(72) Inventors: Diana Canto Estany, Sant Cugat del Valles (ES); Lawrence H White, Corvallis, OR (US); Macia Sole Pons, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/097,527

(22) PCT Filed: Jul. 19, 2016

(86) PCT No.: PCT/US2016/042912

§ 371 (c)(1),
(2) Date: Oct. 29, 2018

(87) PCT Pub. No.: WO2018/017054

PCT Pub. Date: Jan. 25, 2018

(65) Prior Publication Data

US 2019/0126616 A1 May 2, 2019

(51) Int. Cl.

| | |
|---|---|
| ***B41J 2/045*** | (2006.01) |
| ***B41J 2/14*** | (2006.01) |
| *B41J 29/38* | (2006.01) |

(52) U.S. Cl.

CPC ..... *B41J 2/04591* (2013.01); *B41J 2/0458* (2013.01); *B41J 2/04563* (2013.01);
(Continued)

(58) Field of Classification Search

CPC .. B41J 2/04591; B41J 2/04563; B41J 2/0458; B41J 2/04598; B41J 2/14153

See application file for complete search history.

(56) References Cited

U.S. PATENT DOCUMENTS

| | | | |
|---|---|---|---|
| 5,428,376 | A | 6/1995 | Wade et al. |
| 5,714,989 | A | 2/1998 | Wade |

(Continued)

FOREIGN PATENT DOCUMENTS

| | | |
|---|---|---|
| CN | 1628978 | 6/2005 |
| CN | 1713993 | 12/2005 |
| CN | 1966275 | 5/2007 |

*Primary Examiner* — Thinh H Nguyen

(74) *Attorney, Agent, or Firm* — HP Inc. Patent Department

(57) ABSTRACT

Thermal inkjet printing wherein a printhead has ink ejection elements which are energizable by electrical pulses of a given energy with fire pulses of an amplitude (V) and a fire pulse width (fp). A printer controller sends commands to the printhead to spit ink drops, one or more temperature sensors coupled to the printhead measure a temperature of the printhead, and a calibration component coupled to the temperature sensor variably adjusts the fire pulse energy provided to the having ink ejection elements of the printhead. The calibration component initiates calibrating the printhead, spitting a number (X) of ink drops at a frequency (Y) by the electrical pulses, reading and storing printhead temperature, varying the fire pulse energy by repeating spitting ink drops and reading and storing printhead temperature, finding minimum temperature from the stored printhead temperatures, and deriving an operational fire pulse ($fp_{op}$) from a fire pulse ($fp_{on}$) that has produced the minimum temperature, wherein the printer controller uses the operational fire pulse ($fp_{op}$) for printing.

15 Claims, 5 Drawing Sheets

(52) U.S. Cl.
CPC ..... *B41J 2/04598* (2013.01); *B41J 2/14153* (2013.01); *B41J 29/38* (2013.01)

(56) References Cited

U.S. PATENT DOCUMENTS

| | | | | |
|---|---|---|---|---|
| 6,302,507 | B1 | 10/2001 | Prakash et al. | |
| 6,612,673 | B1 | 9/2003 | Giere | |
| 6,705,694 | B1 * | 3/2004 | Barbour | B41J 2/04506 347/19 |
| 7,097,271 | B2 | 8/2006 | Smektala et al. | |
| 7,591,523 | B2 * | 9/2009 | Sheahan | B41J 2/0451 347/14 |
| 8,675,250 | B2 | 3/2014 | Muro et al. | |
| 2002/0024547 | A1 | 2/2002 | Miyakoshi | |
| 2010/0295884 | A1 | 11/2010 | Smektala | |
| 2013/0038657 | A1 | 2/2013 | Viturro et al. | |

* cited by examiner

ADAPTIVE PRINT HEAD CALIBRATION PROCESS

BACKGROUND

Inkjet hardcopy devices, in the following simply called printers, print dots by ejecting very small drops of ink onto the print medium. They may include a movable carriage that supports one or more printheads each having ink ejecting ink ejection elements. Recent printer designs include page-wide printheads. The ink ejection elements are controlled to eject drops of ink at appropriate times pursuant to command of a microcomputer or other controller, wherein the timing of the application of the ink drops is intended to correspond to the pattern of pixels of the image being printed.

A thermal inkjet printhead (e.g., the silicon substrate, structures built on the substrate, and connections to the substrate) uses liquid ink (i.e., dissolved colorants or pigments dispersed in a solvent). It has an array of precisely formed orifices or nozzles attached to a printhead substrate that incorporates an array of ink ejection chambers which receive liquid ink from the ink reservoir. Each chamber is located opposite the nozzle so ink can collect between it and the nozzle and has a firing resistor located in the chamber. The ejection of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink is fed from an ink reservoir integral to the printhead or an "off-axis" ink reservoir which feeds ink to the printhead via tubes or ducts connecting the printhead and reservoir, and is then fed to the various vaporization chambers.

Thermal inkjet printheads require an electrical drive pulse in order to eject a drop of ink. The voltage amplitude, shape and width of the pulse affect the printheads performance. It is desirable to operate the printhead using pulses that deliver a specified amount of energy. The energy delivered depends on the pulse characteristics (width, amplitude, shape), as well as the resistance of the printhead.

A thermal inkjet printhead requires a certain minimum energy to fire ink drops of the proper volume (herein called the turn-on energy). Turn-on energy can be different for different printhead designs, and in fact varies among different samples of a given printhead design as a result of manufacturing tolerances. Different kinds of tolerances add to the uncertainty how much energy is being delivered to any given printhead. Therefore, it is necessary to deliver more energy to the average printhead than is required to fire it (called "over-energy") in order to allow for this uncertainty. As a result, thermal inkjet printers are configured to provide a fixed ink firing energy that is greater than the expected lowest turn-on energy for the printhead cartridges it can accommodate.

The energy applied to a firing resistor affects performance, durability and efficiency. It is well known that the firing energy must be above a certain firing threshold to cause a vapor bubble to nucleate. Above this firing threshold is a transitional range where increasing the firing energy increases the volume of ink expelled. Above this transitional range, there is a higher optimal range where drop volumes do not increase with increasing firing energy. In this optimal range above the optimal firing threshold drop volumes are stable even with moderate firing energy variations. Since, variations in drop volume cause disuniformities in printed output, it is in this optimal range that printing ideally takes place. As energy levels increase in this optimal range, uniformity is not compromised, but energy is wasted and the printhead is prematurely aged due to excessive heating and ink residue build-up.

In typical inkjet printers, as each droplet of ink is ejected from the printhead, some of the heat used to vaporize the ink driving the droplet is retained within the printhead and for high flow rates, conduction can heat the ink near the substrate. These actions can overheat the printhead, which can degrade print quality, cause the ink ejection elements to misfire, or can cause the printhead to stop firing completely. Printhead overheating compromises the inkjet printing process and limits high throughput printing. In addition, current inkjet printheads do not have the ability to make their own firing and timing decisions because they are controlled by remote devices. Consequently, it is difficult to efficiently control important thermal and energy aspects of the printhead.

Traditional printhead calibrations are done at the print head manufacturing lines and the calibration values are stored in the print head. This kind of calibration does not account for ink lot manufacturing variations, nor printhead to printhead variations. It only uses information from printhead manufacturing lot and ink color/type and is not be changed during printer operation.

Therefore, is a need for efficient thermal and energy control of the printhead in a printer.

BRIEF DESCRIPTION OF THE DRAWINGS

Examples will be described, by way of example only, with reference to the accompanying drawings in which corresponding reference numerals indicate corresponding parts and in which.

DETAILED DESCRIPTION

In the following description of the invention, reference is made to the accompanying drawings, which form a part hereof, and in which are shown by way of illustration example of printhead calibration in thermal inkjet printing.

Figure 1:
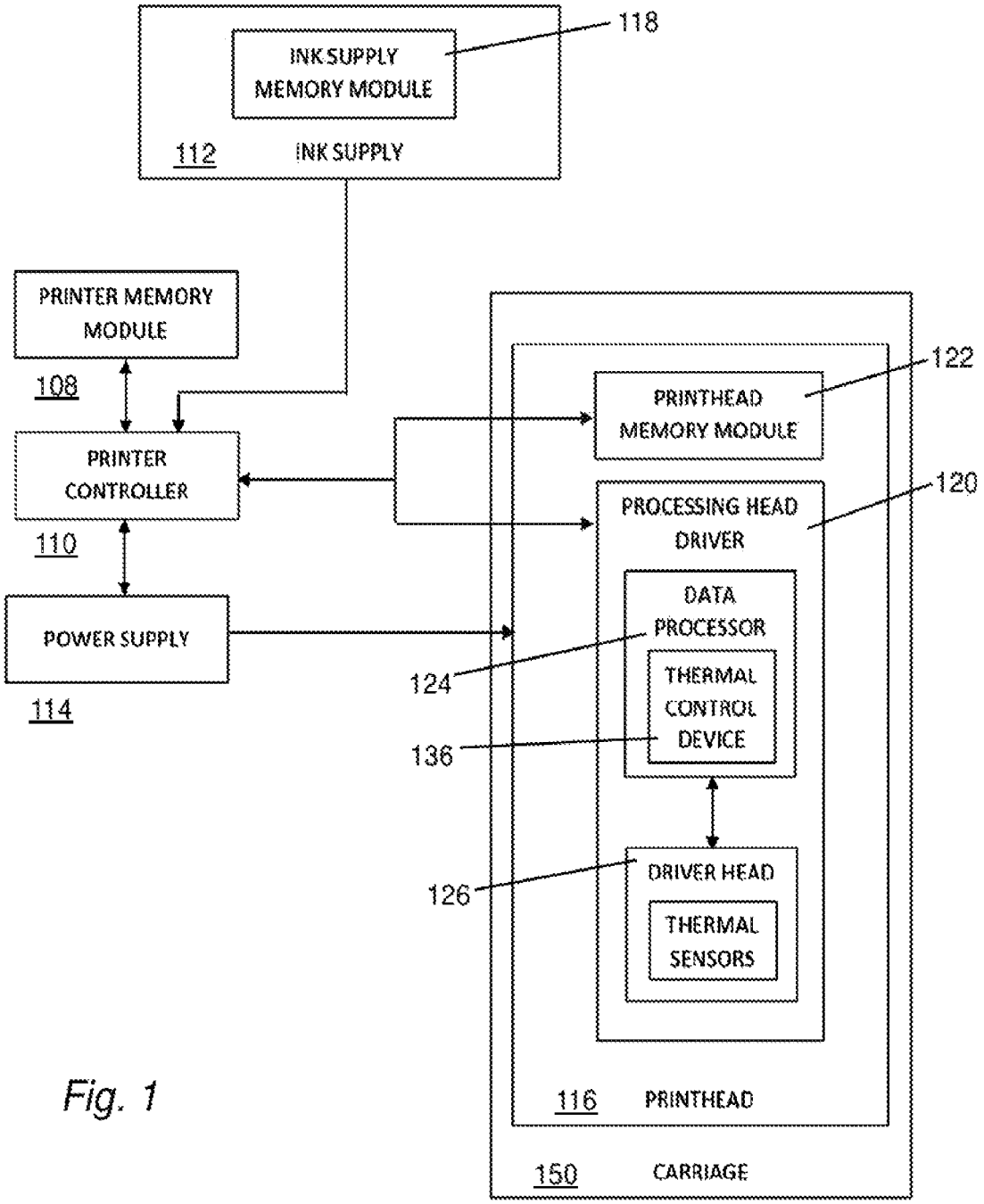
FIG. 1 shows a block diagram of an example printing system.

FIG. 1 shows a block diagram of a thermal inkjet printer 100 according to an example. The printer 100 is a pruner controller 110 coupled to an ink supply 112, a power supply 114 and a printhead 116. The printhead 116 can be mounted in or on a printer carriage, as indicated by 150, or it can be realized in another way, as in a page-wide printer which has no carriage. The ink supply 112 includes an ink supply memory module 118 and is fluidically coupled to the printhead 116 for selectively providing ink to the printhead 116.

Figure 3:
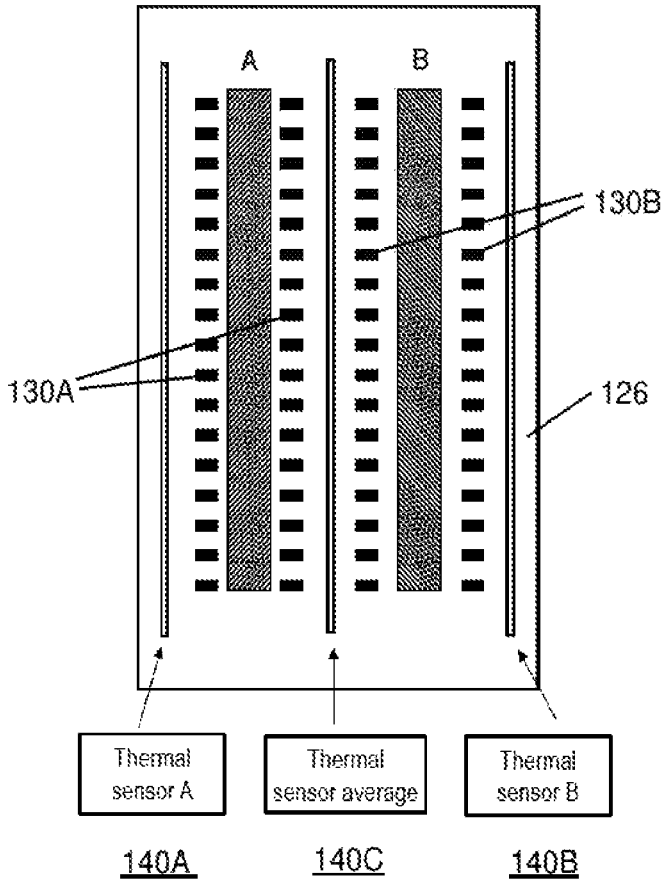
FIG. 3 is a simplified illustration of an example thermal inkjet printhead with different thermal sensors.

The printhead 116 includes a processing head driver 120 and a printhead memory module 122. The processing head driver 120 is comprised of a data processor 124, such as a distributive processor, and a driver head 126, such as an array of inkjet ink ejection elements 130A, B, as shown in FIG. 3.

During operation of the printing system 100, the power supply 114 provides a controlled voltage to the controller 110 and the processing driver head 120. Also, the controller 110 receives print data to process the data into printer control information and into image data. The processed data, image data and other static and dynamically generated data (discussed in detail below), is exchanged with the ink supply 112 and the printhead 116 for controlling the printer.

The ink supply memory module 118 is to store various ink supply specific data, including ink identification data, ink characterization data, ink usage data and the like. The ink supply data can be written and stored in the ink supply memory module 118 at the time the ink supply 112 is manufactured or during operation of the printer 100.

Similarly, the printhead memory module 122 can store various printhead specific data, including printhead identification data, warranty data, printhead characterization data, printhead usage data, etc. This data can be written and stored in the printhead memory module 122 at the time the printhead 116 is manufactured or during operation of the printing system 100.

Although the printhead data processor 124 can communicate with memory modules 118, 122, the data processor 124 preferably primarily communicates with the printer controller 110 in a bi-directional manner.

Such bi-directional communication enables the printhead data processor 124 to dynamically formulate and perform its own firing and timing operations based on sensed and given operating information for regulating the temperature of, and the energy delivered to the processing head driver 120. These formulated decisions are preferably based on, among other things, sensed printhead temperatures, sensed amount of power supplied, real time tests, and preprogrammed known optimal operating ranges, such as temperature and energy ranges. As a result, the printhead data processor 124 enables efficient operation of the processing head driver 120 and produces droplets of ink that are printed on a print media to form a desired pattern for generating printed outputs.

The driver head 126 further includes thermal sensors 140 (FIG. 1) and 140A, B, C (FIG. 3) for dynamically measuring printhead temperature. The sensors 140, 140A, B, C can be analog or digital sensors.

As illustrated in an example in FIG. 3, the sensors 140A, B, C include a thermal sensor 140A of an printhead A which is to print an ink A, and a thermal sensor 140B of an printhead B which is to print an ink B. Another thermal sensor 140C is for measuring an average temperature of the printhead 116. The thermal average sensor 140C can include several sensor elements which are distributed around the driver head so that a "global" temperature is sensed as the average.

Although the data processor 124 can communicate with memory device 122, the data processor 124 preferably primarily communicates with the controller 110 in a bi-directional manner. The bi-directional communication enables the data processor 124 to dynamically formulate and perform its own firing and timing operations based on sensed and given operating information for regulating the temperature of, and the energy delivered to the processing driver head 120. These formulated decisions are preferably based on, among, other things, sensed printhead temperatures, sensed amount of power supplied, real time tests, and preprogrammed known optimal operating ranges, such as temperature and energy ranges. As a result, the data processor 124 enables efficient operation of the processing driver head 120.

The controller 110 or the printhead data processor 124 is to calculate an adjusted pulse width from the nominal pulse width for the driver head 126.

Figure 2:
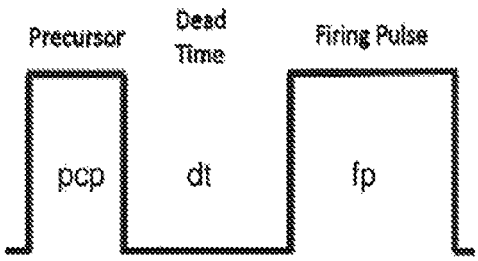
FIG. 2 is a diagram of an example waveform of energizing an ink ejection element in an example printhead.

FIG. 2 illustrates an example of a pulse to energize the ink electing elements of the printhead 116. The pulse width is adjusted to a suitable pulse width based on the temperature sensed by the thermal sensors 140, 140A, B, C. The ink election elements 130A, B in the driver head 126 of the printhead 116 are, by the way of example, energizable by electrical pulses of a given energy with fire pulses of an amplitude (V) and a fire pulse width (fp) to spit ink drops.

As exemplified in FIG. 2, the electrical pulses include a precursor pulse (pcp), a dead time (dt) and the fire pulse width (fp), wherein the total pulse width (pw) is $$pw=pcp+dt+fp.$$

Some printhead calibrations are improved as described now.

Figure 4:
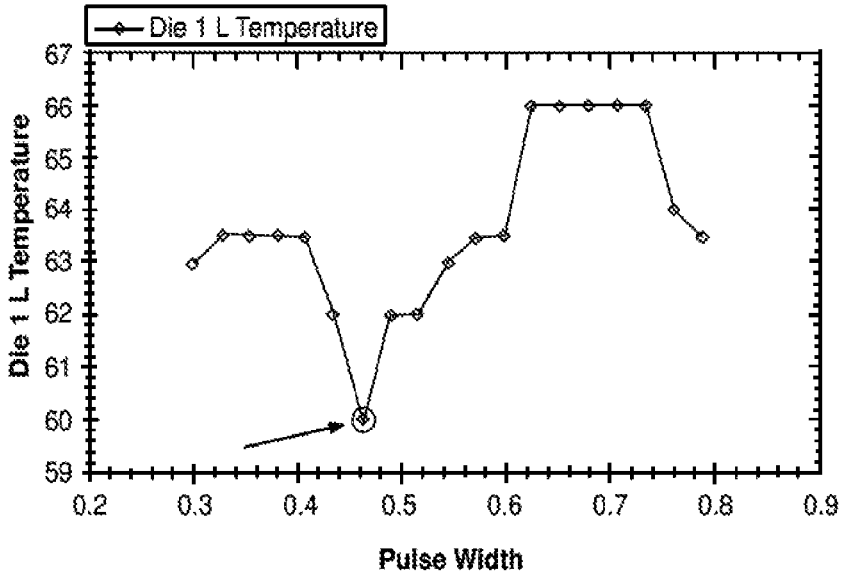
FIG. 4 is a diagram showing printhead temperature versus firing pulse width according to an example.

FIG. 4 shows in an example diagram printhead temperature versus firing pulse width according to an printhead calibration example.

Generally spoken, printhead calibration according to this example includes initiating calibrating the printhead 116, spitting a number X of ink drops, at a frequency Y by the ink ejecting elements 130A, B by electrical energizing pulses, reading and storing printhead temperature by the thermal sensors 140A, B, C, varying the fire pulse energy by repeating spitting ink drops and reading and storing printhead temperature, finding minimum temperature from the stored printhead temperatures, deriving an operational fire pulse $fp_{op}$ from a fire pulse ($fp_{on}$) that has produced the minimum temperature, and using the operational fire pulse $fp_{op}$ for printing. The fire pulse that has produced the minimum temperature is shown encircled in the diagram of FIG. 4

The operational fire pulse $fp_{op}$ which is used for printing is derived from the fire pulse $fp_{on}$ that has produced the minimum temperature by an additional over energy oe. The value of over energy oe is optimized between optimal ink drop quality and minimum energy consumption of the printhead.

According to an example, the operational fire pulse $fp_{op}$ is derived from the fire pulse $fp_{on}$ that has produced the minimum temperature by an additional over energy oe. Varying the pulse energy is by varying the pulse width fp of the fire pulses. In the example, varying the pulse energy is by decreasing the pulse width fp of the fire pulses stalling from a starting fire pulse width $fp_s$.

In an example, the printhead calibration is performed on the basis of at least one of different parameters $k_i$, t. In the example, the parameters include parameters related to ink formulation $k_1$, ink storage age $k_2$, printhead life $k_3$, amount of consumed ink t.

Figure 5:
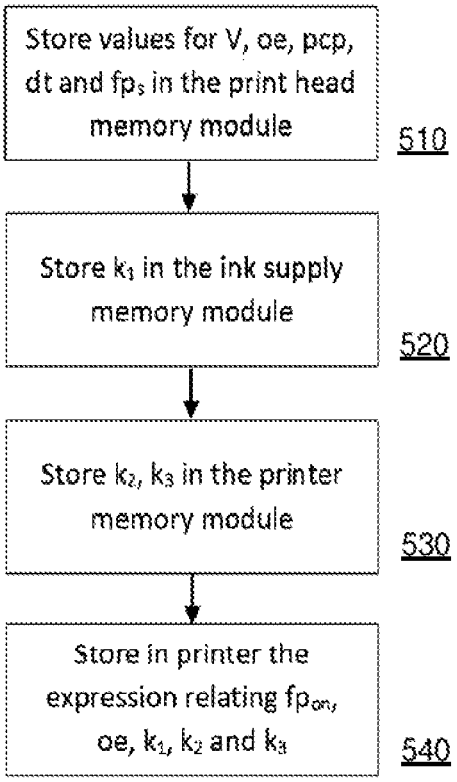
FIG. 5 is a flowchart diagram of storing parameters which are used for printhead calibration according to an example.

Referring to FIG. 5, at 510 the voltage V, over energy oe, precursor pulse pcp, dead time dt and starting fire pulse fps are retrieved from print head memory module 122.

The fire pulse fp and the total pulse width pw are optimised starting from a starting fire pulse fps and a starting total pulse width pws:

$$pws=pcp+dt+fps$$

Next, at 520 the parameter $k_1$ which is related to the formulation of the ink is stored in the ink supply memory module 118. At 530 the parameters $k_2$ related to the ink storage duration and $k_3$ which is related to printhead life are stored in the printer memory module 108, and, at 540, an expression relating $fp_{ton}$, oe, $k_1$, $k_2$ and $k_3$ is stored in the printer memory module 108.

In order not to exceed the energy provided to the system, the operational fire pulse is calculated. Based on $fp_{op}$, than a operational total pulse width $pw_{op}$ can be calculated as well. In the example, V, $p_{cp}$, dt and oe are constants.

Figure 6:
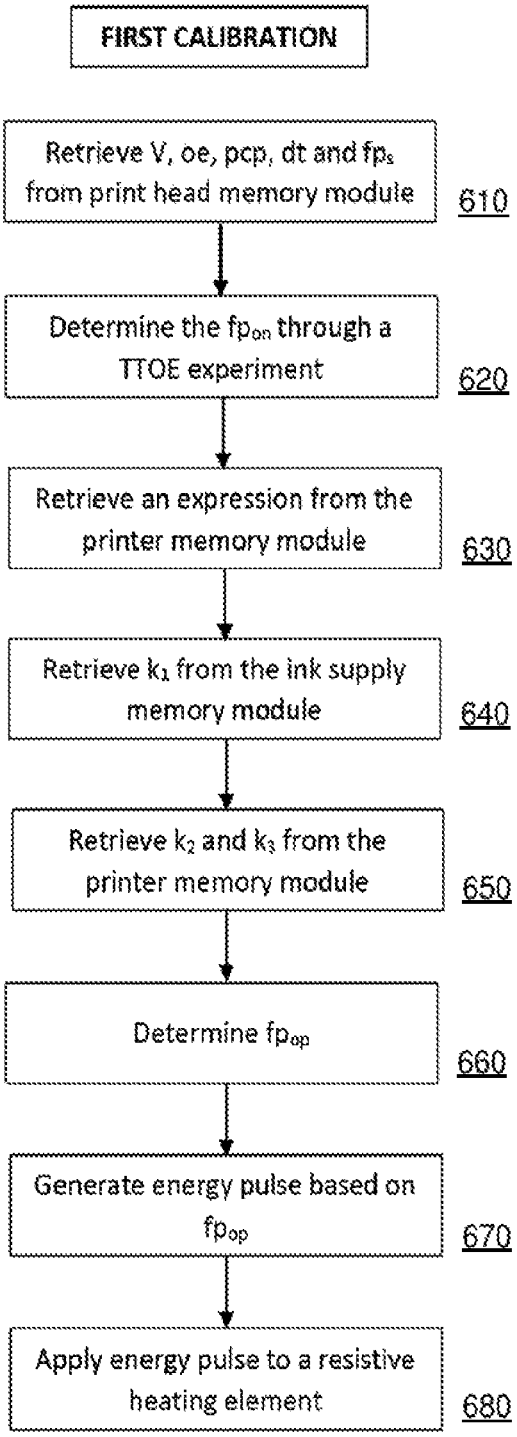
FIG. 6 is a flowchart diagram of a first printhead calibration according to an example.

Now, turning to FIG. 6, which is a general flowchart diagram of a first printhead calibration according to an example, the fire pulse $fp_{on}$ that has produced the minimum temperature is determined from a Thermal Turn On Energy (TTOE) experiment, and the operational fire pulse $fp_{op}$ which is used for printing is determined from the same and from the parameters $k_1$, $k_2$ and $k_3$.

At 610, V, oe, pcp, dt and fp, are retrieved from print head memory module 122. At 620, the fire pulse $fp_{on}$ that has produced the minimum temperature at the driver head 126 of printhead 116, as exemplified in FIG. 4, is determined through a TTOE experiment. The expression relating $fp_{on}$, oe, $k_1$, $k_2$ and $k_3$ as stored in the printer memory module 108 at 540 is retrieved from the same at 630.

At 640 the parameter $k_1$ which is related to the formulation of the ink is retrieved from the ink supply memory module 118, and at 650 the parameters $k_2$ related to the ink storage duration and $k_3$ which is related to printhead life are retrieved from the printer memory module 108.

Then, at 660, the operational fire pulse $fp_{op}$ which is used for printing is derived from the fire pulse $fp_{on}$ by the expression relating $fp_{on}$, oe, $k_1$, $k_2$ and $k_3$ as it is stored in the printer memory module 108 at 540.

The operational fire pulse $fp_{op}$ is used for printing by generating energy pulses based on $fp_{op}$ at 670 and applying energy pulses to a resistive heating element of the ink ejecting element 130A; 130B at 680.

Figure 7:
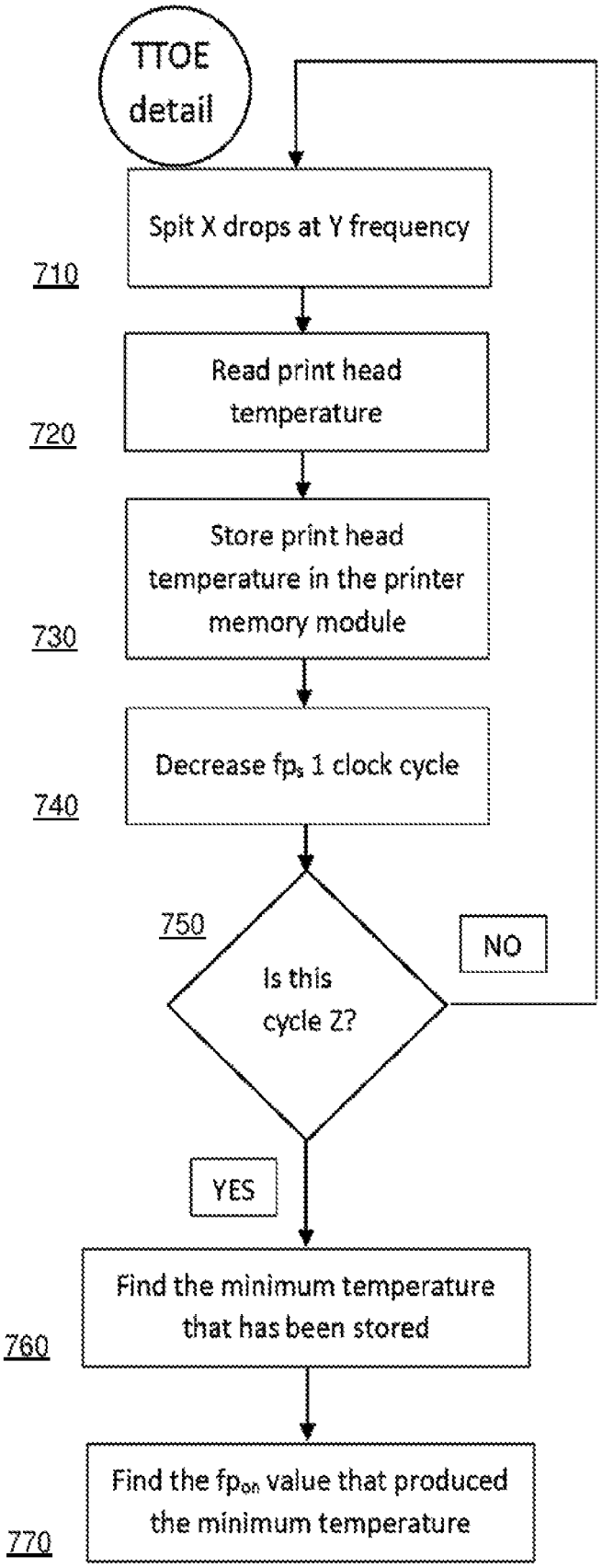
FIG. 7 is a flowchart diagram of a thermal over energy calibration in a printhead according to an example.

FIG. 7 is a flowchart diagram of a thermal over energy calibration in a printhead according to an example, wherein the turn on energy fire pulse $fp_{on}$ is determined through Thermal Turn On Energy (TTOE) in an experiment:

At 710, the printer automatically spits X drops at Y frequency using the energy parameters V, pcp, dt, $fp_s$ that have been retrieved from the memories 108, 118, and reads, at 720, the print head temperature by the sensors 140, 140A, B right after the drops have been fired. At 730, the print head temperature is stored in the printer memory module 108.

The printer repeats spitting the drops but decreasing the starting fire pulse $fp_s$ one clock at a time during Z cycles which is referenced by 740.

At 750, a decision is made whether a predetermined number Z of cycles is reached, and if NO, return is to 710 when the printer spits X drops at Y frequency with the fire pulse fp which has been decreased at 740. On the other hand, if at 750 the decision is YES indicating that the predetermined number Z of cycles is reached, at 760 the minimum temperature from the stored printhead temperatures is determined, and the fire pulse $fp_{on}$ that has produced the minimum temperature is determined, as referenced at 770.

Figure 8:
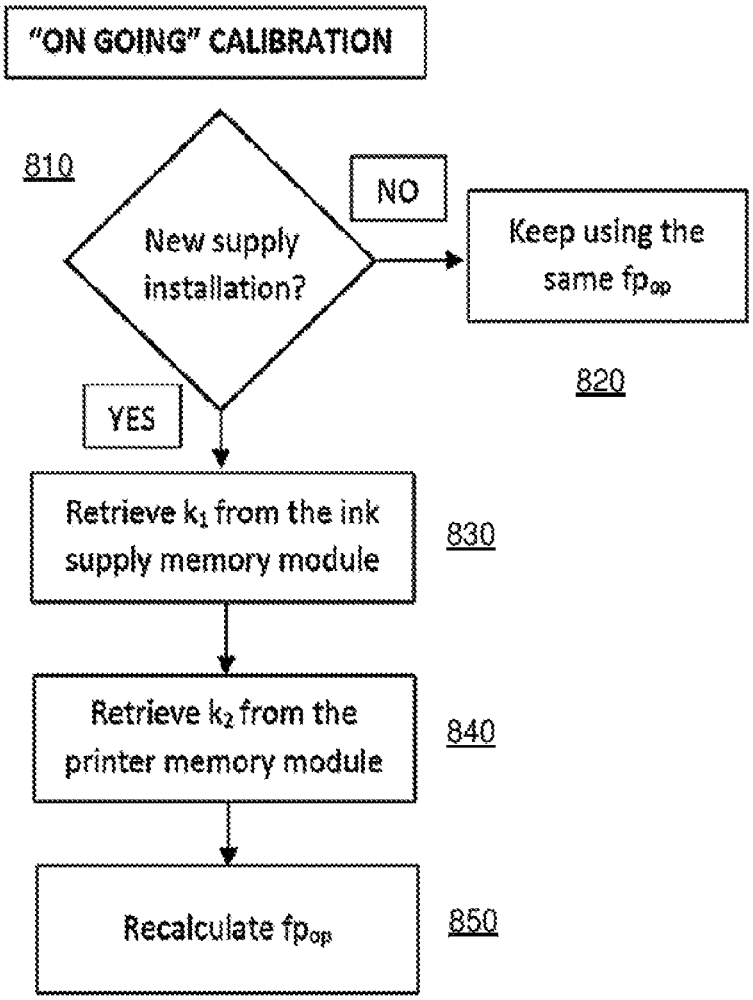
FIG. 8 is a flowchart diagram of an ongoing printhead calibration according to an example.

FIG. 8 is a flowchart diagram of an ongoing printhead calibration according to an example, wherein a calibration is initiated when a new ink supply is been installed. At 810 a decision is whether a new supply installation wok place. If the answer is NO, no new calibration is executed by keep using the same $fp_{op}$ as indicated at 820. On the other hand, when at 810 the answer is YES in that a new ink supply has been installed, at 830 the parameter $k_1$ related to the formulation of the ink is retrieved from the ink supply memory module 118. At 840, the parameter $k_2$ related to the ink storage is retrieved from the printer memory module 108. At 850 the fire pulse $fp_{op}$ is recalculated.

Printhead TOE and/or Percentage over Energy calibration, i.e. the Thermal Turn On Energy (TTOE) calibration is determined the first time the print head is installed in the printer according to the ink that is being used at any particular time. If a new ink supply is installed, the printer analyses the ink properties for that particular ink supply and if they are different to the previous ink supply, triggers a new TOE calibration to compensate ink variations. This is a critical process that sets the required energy delivered to the Print Head. This setting is a compromise between optimal ink drop volume and minimum energy consumption. Percentage Over energy is the amount of extra energy delivered to the printhead to overcome specific printhead and or ink defects.

This critical printhead calibration depends on many different variables, as ink technology (dye inks; pigment inks, latex based inks), ink color within ink technology (Black, Cyan, Magenta, Yellow, Light Cyan, Light Magenta, . . . ), ink lot manufacturing within ink color.

Other compensations improve performance, like drop weight compensation for more accurate ink accounting and color compensation in case that printer color calibration is not done, or bidirectional alignment compensation in case that a particular ink lot has effects on drop velocity and the user has not completed a printhead alignment after changing the ink supply.

Figure 9:
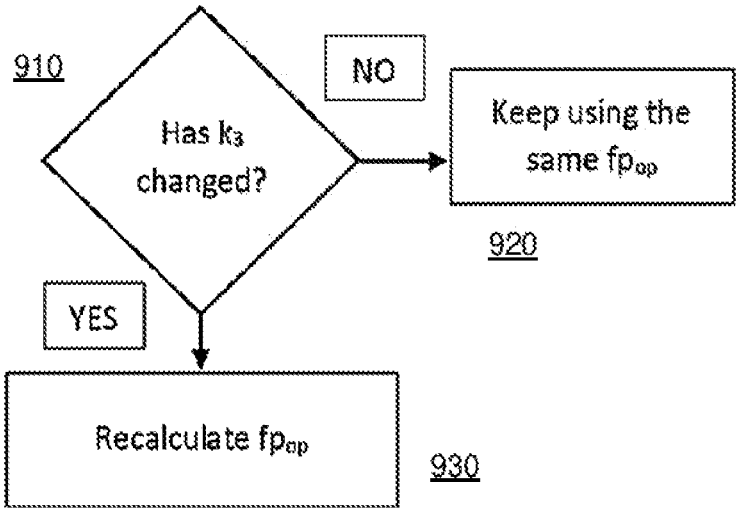
FIG. 9 is a flowchart diagram of a printhead calibration related to printhead life according to an example.

FIG. 9 is a flowchart diagram of a printhead calibration related to printhead life according, to an example. At 910 a decision is whether the parameter $k_3$ related to the print head life has changed. If the answer is NO, no new calibration is executed by keep using the same $fp_{op}$ as indicated at 920. On the other hand, when at 810 the answer is YES in that the parameter $k_3$ related to the print head life has changed, at 930 the parameter $k_3$ is retrieved from the ink supply memory module 118, and the fire pulse $fp_{op}$ is recalculated.

$fp_{on}$ is the maximum firing pulse that provides the first relative minimum of temperature.

The printhead calibrations are determined as a function of all listed variables, which allows the printhead to fire with the optimum energy settings, and ensures the printhead ejects the ink drops at the right speed and right size.

As explained above the calibration is based on measurements of the printhead temperature. The printhead includes one or more sensors for the temperature measurements. In an example, one sensor 140A, 140B is for measurement of each color, and one sensor 140C is for the average temperature.

EXAMPLE

Retrieve the expression relating $fp_{on}$, oe, $k_1$, $k_2$ and $k_3$ from the printer memory module 108. Retrieve $k_1$ from the ink supply memory module 118. Retrieve $k_2$ and $k_3$ from the printer memory module 108. Determine the operational firing pulse ($fp_{op}$) based on the expression:

$$fp_{op} = fp_{ton} * \frac{oe + 0.075}{1.075} * \left(1 + \frac{k_1 + k_2 + k_3}{100}\right)$$

Where:

$$fp_{ton} * \frac{oe + 0.075}{1.075}$$

is the nominal value for the operational firing pulse.

$$\frac{k_1 + k_2 + k_3}{100}$$

represents the energy adjustment during the print head life, based on ink-related and print head related conditions.

$k_1$ is related to the formulation of the ink. There might be differences in formulation between the ink present in the system (print head, tubes, etc.) and the one in the ink supplies that are being replaced.

$$k_1 = \left(\frac{\alpha_{new}}{\alpha_{old}} - 1\right) * \left(\frac{\operatorname{arctg}\left(t - \frac{V_{ph}}{2} - V_t\right)}{\pi} + \frac{1}{2}\right)\left(\frac{\alpha_{new}}{\alpha_{old}} - 1\right)$$

represents how different inks night be.

$\alpha_{new}$ and $\alpha_{old}$ are ink-related constants retrieved from the ink supply memory module.

$$\left(\frac{\operatorname{arctg}\left(t - \frac{V_{ph}}{2} - V_t\right)}{\pi} + \frac{1}{2}\right)$$

allows applying the energy changes gradually and only from the moment the new ink coming from the supply gets to the print head.

t is the ink from the supply that has been consumed.

$V_{ph}$ is the ink volume of the print head.

$V_t$ is the ink volume inside the tubes of the printhead.

$k_2$ is related to ink storage. Based on the manufacturing date of the ink, an increase of energy might be triggered by changing $k_2$ according to reference experimental data retrieved from the printer memory module 108.

The "on going" calibration (FIG. 8) has three variables:

$k_1$ is triggered when the new supply is installed, it depends on how different the new ink is from the previous ink (ink physics/properties related parameter)

$k_2$ is triggered when the new supply is installed, it depends on how long the ink has been stored in the supply (how old is the ink)

Example:

| Manufacturing date | $k_2$ |
|---|---|
| <6 months | 0 |
| 6 to 12 months | 2 |

-continued

| Manufacturing date | $k_2$ |
|---|---|
| 12 to 18 months | 6 |
| >18 months | 12 |

$k_3$ is related to print head life. Drop velocity data is regularly gathered by the printer. Based on this data, an increase of energy might be triggered by changing $k_3$ in a similar way as $k_2$.

The new printhead calibration processes are done in the printer during the printhead insertion process and recalibrated based on the information stored in the ink supply and on the printhead usage.

The invention claimed is:

1. A method of calibrating a printhead in a thermal inkjet printer, the printhead having ink ejection elements which are energizable by electrical pulses of a given energy with fire pulses of an amplitude (V) and a fire pulse width (fp) to spit ink drops, comprising initiating calibrating the printhead, spitting a number (X) of ink drops at a frequency (Y) by the electrical pulses, reading and storing printhead temperature, varying the fire pulse energy by repeating spitting ink drops and reading and storing printhead temperature, finding minimum temperature from the stored printhead temperatures, deriving an operational fire pulse ($fp_{op}$) from a fire pulse ($fp_{on}$) that has produced the minimum temperature, using the operational fire pulse ($fp_{op}$) for printing.

2. The method of claim 1, wherein the operational fire pulse ($fp_{op}$) is derived from the fire pulse ($fp_{on}$) that has produced the minimum temperature by an additional over energy (oe), wherein the value of over energy (oe) is optimized between optimal ink drop quality and minimum energy consumption of the printhead.

3. The method of claim 1, wherein the operational fire pulse ($fp_{op}$) is derived from the fire pulse ($fp_{on}$) that has produced the minimum temperature by an additional over energy (oe), and from at least one of different parameters ($k_i$, t) which include parameters related to ink formulation ($k_1$), ink storage age ($k_2$), printhead life ($k_3$), amount of consumed ink (t).

4. The method of claim 1, wherein varying the pulse energy is by varying the pulse width (fp) of the fire pulses.

5. The method of claim 1, wherein varying the pulse energy is by decreasing the pulse width (fp) of the fire pulses starting from a starting fire pulse width ($fp_s$).

6. The method of claim 1, wherein the electrical pulses include a precursor pulse (pcp), a dead time (dt) and the fire pulse width (fp), wherein the total pulse width (pw) is $$pw = pcp + dt + fp.$$

7. The method of claim 1, wherein calibrating the printhead is initiated by one or more of print head manufacturing variation, printhead life, ink formulation, ink storage age, amount of consumed ink.

8. A thermal inkjet printer including a printhead having ink ejection elements which are energizable by electrical pulses of a given energy with fire pulses of an amplitude (V) and a fire pulse width (fp), a printer controller to send commands to the printhead to spit ink drops, one or more temperature sensors coupled to the printhead and to measure a temperature of the printhead, and a calibration component coupled to the temperature sensor and to variably adjust the fire pulse energy provided to the having ink ejection elements of the printhead, wherein the calibration component is to initiate calibrating the printhead, spitting a number (X) of ink drops at a frequency (Y) by the electrical pulses, reading and storing printhead temperature, varying the fire pulse energy by repeating spitting ink drops and reading and storing printhead temperature, finding minimum temperature from the stored printhead temperatures, and deriving an operational fire pulse ($fp_{op}$) from a fire pulse ($fp_{on}$) that has produced the minimum temperature, and the printer controller uses the operational fire pulse ($fp_{op}$) for printing.

9. The thermal inkjet printer of claim 8, wherein the temperature sensors include a temperature sensor to measure temperature at ink ejection elements associated to one or more inks, and one or more temperature sensors to measure an average printhead temperature.

10. The thermal inkjet printer of claim 8, wherein the calibration component is included in the printer controller.

11. The thermal inkjet printer of claim 8, wherein the calibration component is to derive the operational fire pulse ($fp_{op}$) from the fire pulse ($fp_{on}$) that has produced the minimum temperature by an additional over energy (oe), and from at least one of different parameters ($k_i$, t) which include parameters related to ink formulation ($k_1$), ink storage age ($k_2$), printhead life ($k_3$), amount of consumed ink (t).

12. A computer readable medium having a set of computer executable instructions thereon for causing a device to perform a method of calibrating a printhead in a thermal inkjet printer, the printhead having ink ejection elements which are energizable by electrical pulses of a given energy with tire pulses of an amplitude (V) and a fire pulse width (fp) to spit ink drops, the method comprising:

initiating calibrating, the printhead, spitting a number (X) of ink drops at a frequency (Y) by the electrical pulses, reading and storing printhead temperature, varying the fire pulse energy by repeating spitting ink drops and reading and storing printhead temperature, finding minimum temperature from the stored printhead temperatures, deriving an operational fire pulse ($fp_{op}$) from a fire pulse ($fp_{on}$) that has produced the minimum temperature, using the operational fire pulse ($fp_{op}$) for printing.

13. The medium of claim 12, wherein varying the pulse energy is by varying the pulse width (fp) of the fire pulses.

14. The medium of claim 12, wherein varying the pulse energy is by decreasing the pulse width (fp) of the fire pulses starting from a starting fire pulse width ($fp_s$).

15. A thermal inkjet printhead having ink ejection elements which are energizable by electrical pulses of a given energy with fire pulses of an amplitude (V) and a tire pulse width (fp), to receive print control commands sent to the printhead to spit ink drops, one or more temperature sensors coupled to the printhead and to measure a temperature of the printhead, and a calibration component coupled to the temperature sensor and to variably adjust the fire pulse energy provided to the having ink election elements of the printhead, wherein the calibration component is to initiate calibrating the printhead, spitting a number (X) of ink drops at a frequency (Y) by the electrical pulses, reading and storing printhead temperature, varying the fire pulse energy by repeating spitting ink drops and reading and storing printhead temperature, finding minimum temperature from the stored printhead temperatures, and deriving an operational fire pulse ($fp_{op}$) from a fire pulse ($fp_{on}$) that has produced the minimum temperature.

* * * * *